US005589871A

United States Patent [19]

Aoki et al.

[11] Patent Number: 5,589,871

[45] Date of Patent: Dec. 31, 1996

[54] IMAGE FORMING APPARATUS WITH SAFETY SWITCH AND CURRENT DISSIPATING CONTROLLER

[75] Inventors: Mikiyuki Aoki; Kunihiko Omura, both of Toyohashi, Japan

[73] Assignee: Minolta Camera Kabushiki Kaisha, Osaka, Japan

[21] Appl. No.: 186,802

[22] Filed: Jan. 25, 1994

[30] Foreign Application Priority Data

Jan. 26, 1993 [JP] Japan ..... 5-011035

[51] Int. Cl.[6] ..... B41J 2/435

[52] U.S. Cl. ..... 347/237; 347/247

[58] Field of Search ..... 347/247, 237; 355/206, 207

[56] References Cited

U.S. PATENT DOCUMENTS 5,160,966 11/1992 Shiina et al. ..... 355/206

FOREIGN PATENT DOCUMENTS 4-127837 4/1992 Japan .

*Primary Examiner*—Mark J. Reinhart

*Attorney, Agent, or Firm*—Price, Gess & Ubell

[57] ABSTRACT

In the present invention, after a motor is electrically disconnected from a power source by a safety switch, said motor is electrically disconnected from a circuit connected thereto by means of a diode. Therefore, the effects of a regenerative electric force generated by said motor in a circuit connected to said motor are eliminated, and the voltage of said circuit connected to said motor is less than a standard safety voltage level.

16 Claims, 3 Drawing Sheets

IMAGE FORMING APPARATUS WITH SAFETY SWITCH AND CURRENT DISSIPATING CONTROLLER

BACKGROUND OF THE INVENTION

1. Field of the Invention

The present invention relates to an image forming apparatus provided with a load and a power source for driving said load, and a safety switch for switching an electrical connection and a disconnection between said load and said power source in conjunction with the opening and closing of a cover provided on the image forming apparatus so as to be operational.

2. Description of the Prior Art

Image forming apparatus such as digital copying machines, laser printers and the like typically provide a deflection device such as a polygonal mirror, galvano-mirror or the like to modify a laser beam modulated in accordance with image information.

The aforesaid deflection devices are typically driven at extremely high speed to accelerate image recording. A polygonal mirror, in particular, is rotatably driven at a high speed of 5,000 rpm via a polygonal mirror motor (hereinafter referred to as "polygonal motor"). In the description that follows, examples pertain to a laser printer provided with the aforesaid polygonal motor.

Laser printers are typically provided with an operational cover to allow easy processing of paper jams, routine maintenance, inspections and the like. In consideration of safety factors during paper jam processing and maintenance inspections, a safety switch is provided for switching an electrical connection and a disconnection between the load and power source for driving said load in conjunction with the opening and closing of the aforesaid cover.

FIG. 1 shows an example of a drive circuit for a laser printer. As shown in the drawing, the aforesaid drive circuit comprises a polygonal motor drive circuit 101 for driving a polygonal motor 110, a laser beam drive circuit 102 for driving a semiconductor laser that generates a laser beam, a main motor drive circuit 103 for driving a main motor 111 that drives the paper feed device and fixing device and the like, and other loads 104 which are connected to a low-voltage power source 100 via the safety switch SW. In the previously mentioned state wherein the cover is closed, the safety switch SW is switched ON, and the aforesaid polygonal motor drive circuit 101, laser beam drive circuit 102, main motor drive circuit 103 (hereinafter referred to as "drive circuits 101 through 103"), and load 104 are electrically connected to the low-voltage power source 100. When the aforesaid cover of the laser printer is opened for routine maintenance inspection, the safety switch SW is turned OFF in conjunction with the operation of opening said cover, such that the aforesaid drive circuits 101 through 103, and load 104 are electrically disconnected from the low-voltage power source 100.

Disadvantages inherent to the above-described laser printer are described below.

Since the polygonal mirror is rotated at exceptionally high speed during image recording, when the cover is opened while the polygonal mirror is rotating, said polygonal mirror continues to rotate even after the safety switch SW is turned OFF due to the force of inertia. Therefore, although the aforesaid drive circuits 101 through 103, and load 104 are electrically disconnected from the low-voltage power source when the safety switch SW is turned OFF, the polygonal motor 110 continues to generate a regenerative electric force flowing in the arrow direction in the drawing, relative to the main motor drive circuit 103 and load 104. When this regenerative electric force is generated, a disadvantage arises inasmuch as a voltage is applied to the laser drive circuit 102, main motor drive circuit 103 and load 104 connected to the polygonal motor drive circuit 101, such that standard voltage safety levels are not satisfied. This disadvantage is such that the safety switch SW does not fulfil its function.

SUMMARY OF THE INVENTION

An object of the present invention is to provide an image forming apparatus which, after electrically disconnecting the power source and load by turning OFF a safety switch, quickly sets the voltage of the circuits connected to a motor at a voltage less than a standard safety level.

Accordingly, the present invention provides in an image forming apparatus, a motor, a power source for driving said motor, a cover provided so as to be capable of opening and closing relative to a body of the apparatus, a safety switch for switching an electrical connection and disconnection between said motor and said power source in conjunction with the opening-closing operation of said cover, and an interrupt member for interrupting an outflow of a regeneration current generated by said motor when said motor is disconnected from said power source by said safety switch.

The present invention further provides in an image forming apparatus, a plural loads which are driven for forming images, including a motor, a power source for driving said motor, a cover provided so as to be capable of opening and closing relative to a body of the apparatus, a safety switch for electrically disconnecting said loads from said power source when said cover is opened, and a controller for energizing said loads so as to apply a regeneration current generated by said motor thereto when said cover is opened.

The present invention further provides in an image forming apparatus, a motor for driving a scanning mirror, a power source for driving said motor, an openable cover to a body of the apparatus, a safety switch for electrically disconnecting said motor from said power source when said cover is opened, and a braking device for braking the rotation of said scanning mirror by a regeneration current generated by the motor after said cover is opened.

The present invention further provides in an image forming apparatus, a motor, a plural loads which are driven for forming images, a power source for driving said motor and said plural loads, a cover provided so as to be capable of opening and closing relative to a body of the apparatus, a safety switch for switching an electrical connection and a disconnection between said motor and said power source in conjunction with the opening-closing operation of said cover, and controller for controlling operation of said motor and said loads for forming images when said cover is closed and for actuating the predetermined load to be driven by a regenerative electric force generated by said motor when said cover is opened.

These and other objects, advantages and features of the invention will become apparent from the following description thereof taken in conjunction with the accompanying drawings which illustrate specific embodiments of the invention.

BRIEF DESCRIPTION OF THE DRAWINGS

In the following description, like parts are designated by like reference numbers throughout the several drawings.

DETAILED DESCRIPTION OF THE PREFERRED EMBODIMENTS

First Embodiment

A first embodiment of the present invention is described hereinafter with reference to the accompanying drawings.

Figure 2:
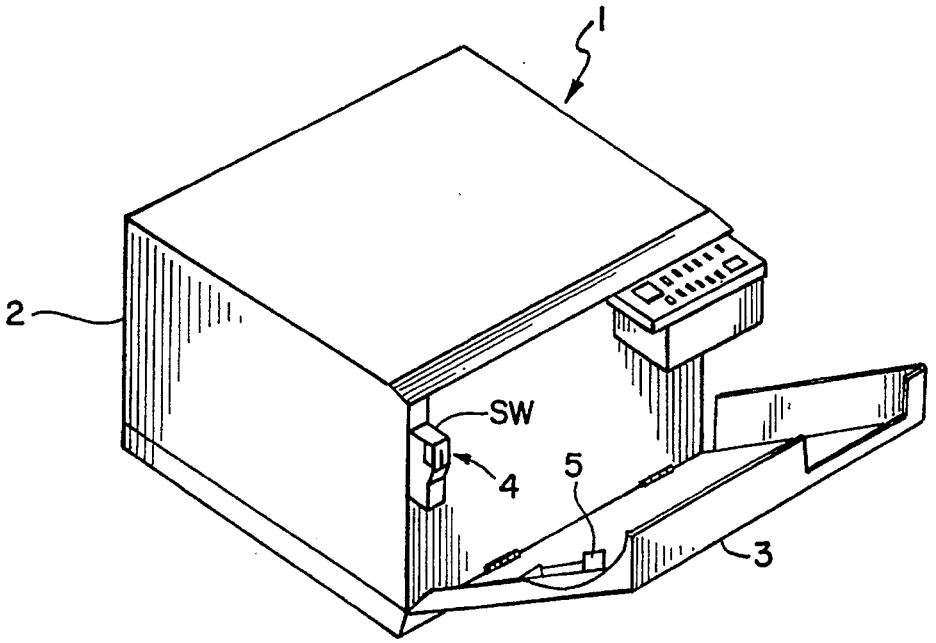
FIG. 2 is an exterior view of the laser printer of the present invention.

FIG. 2 is an exterior view of a laser printer 1 of an electrophotographic type of the present invention. Laser printer 1 is provided with a housing 2, and cover 3 arranged on the side of said housing 2 so as to be capable of opening and closing. Various devices for accomplishing the image forming process are provided within the housing 2 (although not shown in the drawing), such as an optical system for emitting a laser beam, photosensitive member for forming electrostatic latent images, charging device for charging said photosensitive member, developing device for developing said electrostatic latent image as a toner image, transfer device for transferring said toner image to paper sheet, transporting device for transporting said paper sheet, fixing device for fixing said toner image on said paper sheet, and the like. Normally, the aforesaid cover 3 is in a closed state. However, the cover 3 may be opened to gain access to the interior of the printer I in accordance with requirements for paper jam processing, routine maintenance inspection and the like.

As shown in FIG. 2, a safety switch SW, which operates in conjunction with the operation of the aforesaid cover 3, is provided in the laser printer 1 at a position opposite said cover 3. The safety switch SW switches electrical connection and disconnection between a low-voltage power source 100 provided within the housing 2, the drive circuits which are driven by said low-voltage power source 100, and a load. A groove 4 is provided on the safety switch SW at a position facing said cover 3. The interior surface of the cover 3 is provided with a protrusion 5 at a position facing the groove 4. In the closed state of the cover 3, the protrusion 5 is inserted into the groove 4 to turn ON the safety switch SW. When the protrusion 5 is released from the groove 4 in conjunction with the operation of opening the cover 3, the safety switch SW is turned OFF.

Figure 3:
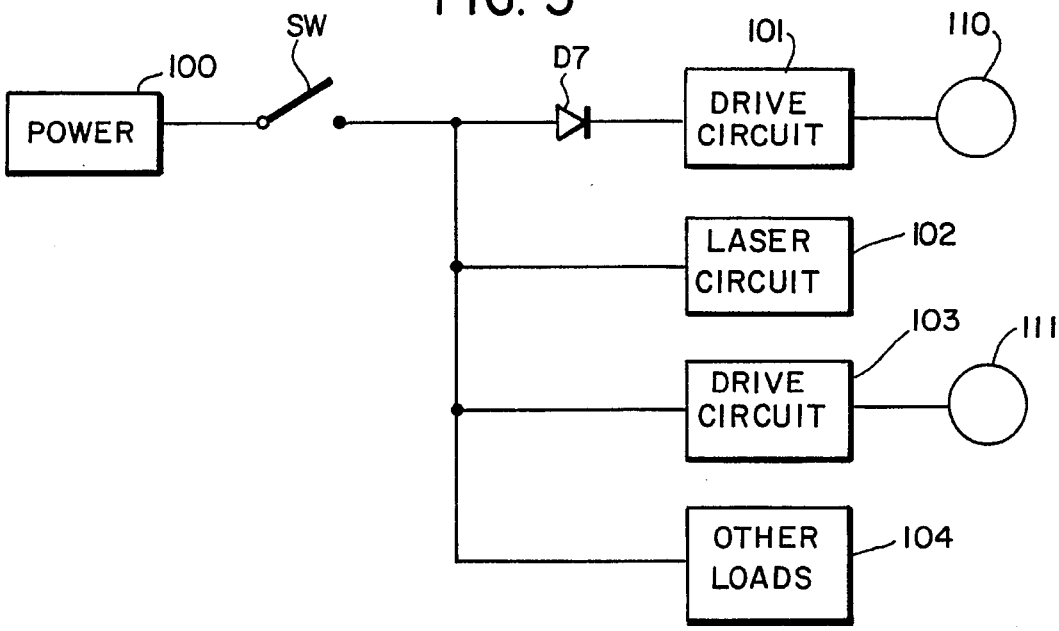
FIG. 3 is a block diagram of the drive circuit of a first embodiment of the invention.

FIG. 3 is a block diagram showing a portion of the drive circuit of the first embodiment. As shown in the drawing, a diode D7 is connected medially to the laser drive circuit 102, main motor 103, and load 104, polygonal motor drive circuit 101. A cathode of the diode D7 is connected to the polygonal motor drive circuit 101, and an anode of the said diode D7 is connected to the laser drive circuit 102. FIG. 3 shows the state wherein the safety switch SW is turned OFF to electrically disconnect between the low-voltage power source 100 and the aforesaid drive circuits 101 through 103, and load 104.

Figure 4:
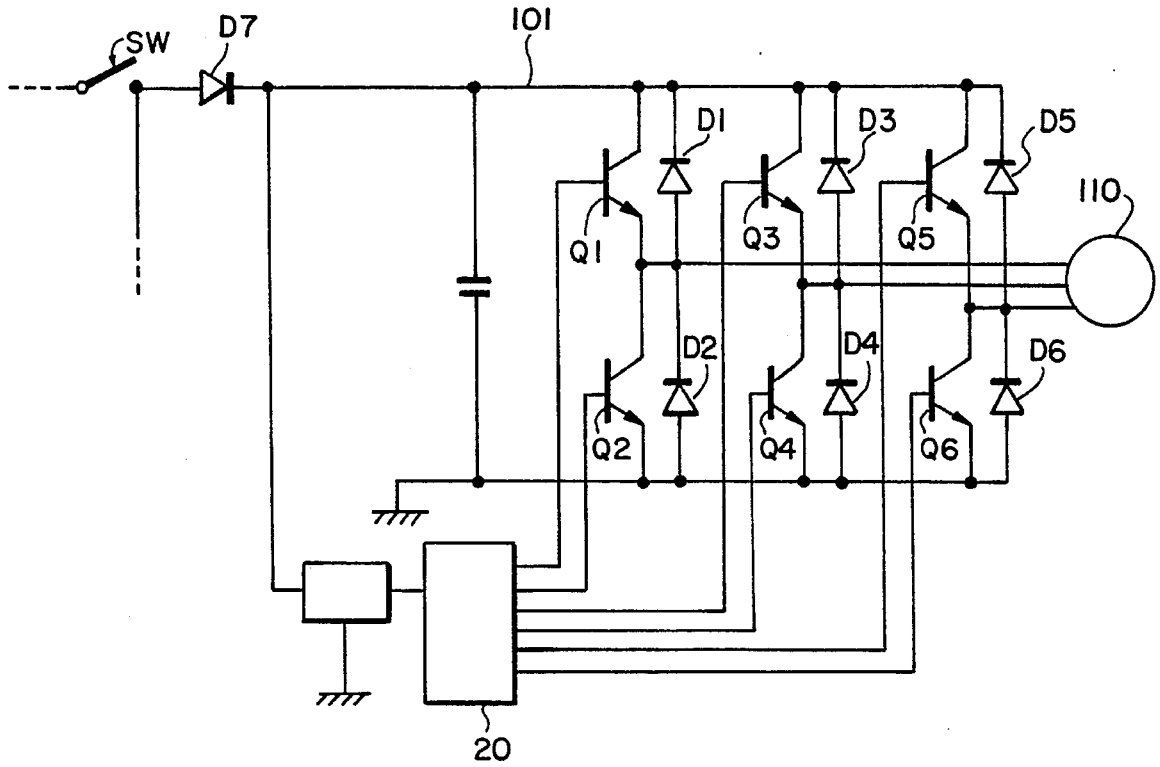
FIG. 4 is a circuit diagram showing the construction of polygonal motor drive circuit 101.

FIG. 4 shows the construction of the polygonal motor drive circuit 101. The polygonal motor drive circuit 101 rotates the polygonal motor 110 via pulse waves generated by the switching of the transistors Q1 through Q6 by the pulse control circuit 20.

Next, we consider the circumstance wherein the safety switch SW is turned OFF because the cover 3 is opened during the rotation of the polygonal motor 110. In this case, the low-voltage power source 100 is electrically disconnected from the drive circuits 101 through 103, and load 104, but the polygonal mirror continues to rotate due to the force of inertia. Since the polygonal motor 110 also continues to rotate due to the force of inertia of the polygonal mirror, a regenerative electric force is generated and flows from said polygonal motor 110 to the diode D7.

The polygonal motor drive circuit 101 is electrically disconnected from the laser drive circuit 102, the main motor drive circuit 103 and the load 104 by means of the diode D7. Accordingly, the voltage applied to the drive circuits 102 and 103, and the load 104 immediately drops to less a standard safety level.

Although in the first embodiment the diode D7 is used as the element for electrically disconnecting the polygonal motor drive circuit 101 from the aforesaid drive circuits 102 and 103 and the load 104, it is to be noted that the present invention is not limited to the use of a diode insofar as another element or circuit may be used to prevent the flow of current from the polygonal motor drive circuit 101.

Second Embodiment

A second embodiment of the invention is described hereinafter. The exterior construction of the laser printer 1 is identical to that of the first embodiment shown in FIG. 2.

Figure 1:
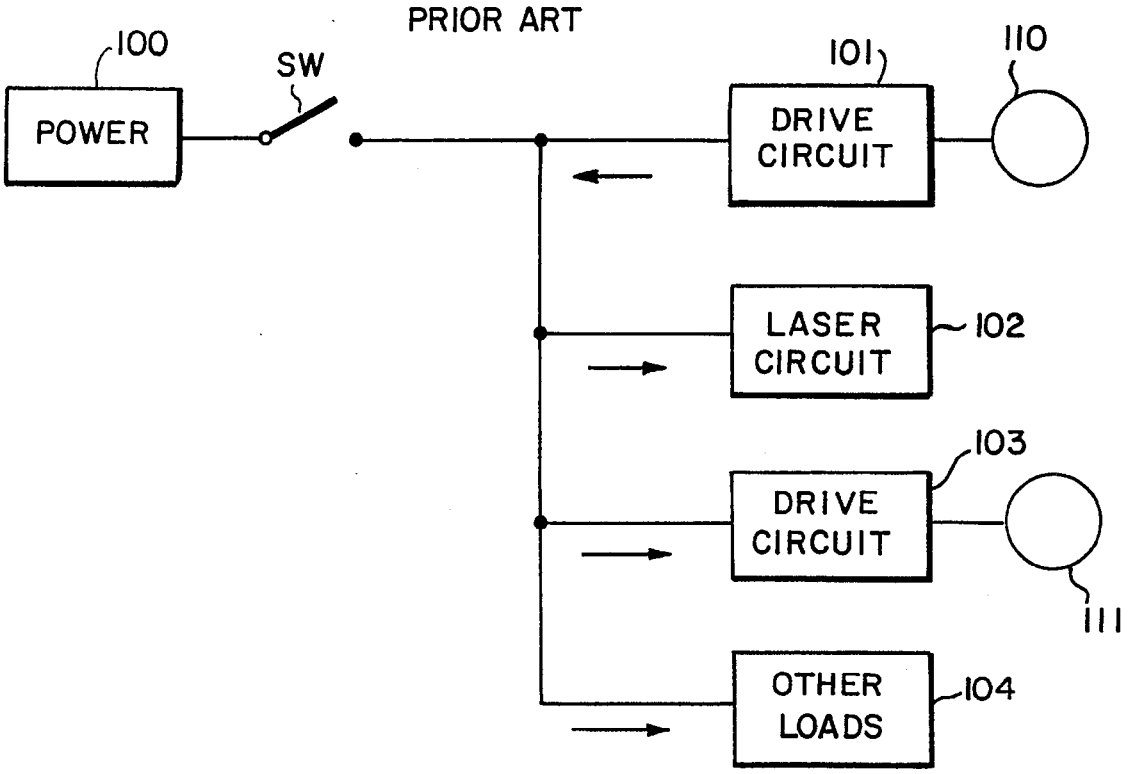
FIG. 1 PRIOR ART
FIG. 1 is a block diagram showing the construction of a conventional laser printer drive circuit.
Figure 5:
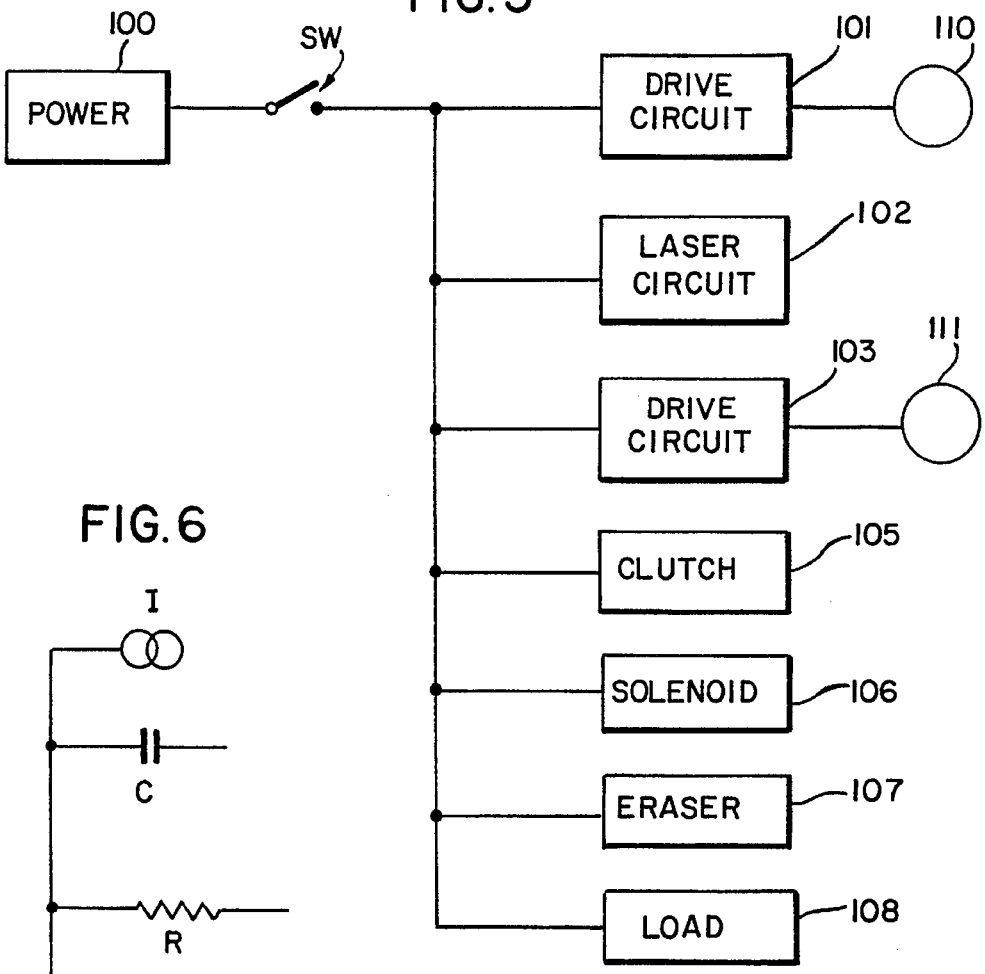
FIG. 5 is a block diagram showing the drive circuit of a second embodiment of the invention.

FIG. 5 is a blockdiagram showing the construction of the drive circuit of the second embodiment. The basic construction of the second embodiment is similar to that shown in FIG. 1. As shown in FIG. 5, the load 104 is more specifically replaced by a load group 105 through 108 comprising a clutch 105 which disconnects the main motor 111 from various supplemental drive members such as feed rollers and the like, solenoid 106 provided for the various process devices, eraser 107 for eliminating the charge on the surface of the photosensitive member, and load 108. The previously mentioned drive circuits group 101 through 103 and load group 105 through 108 respectively are connected to a microcomputer not shown in the drawing, and are suitably actuated in accordance with the output signals from said microcomputer. The aforesaid microcomputer transmits signals determining the operating state of the eraser 107 to said eraser 107 when the safety switch SW is turned OFF.

For example, when the cover 3 is opened while the polygonal motor 110 is rotating, the safety switch SW is turned OFF to electrically disconnect the low-voltage power source 100 and the drive circuit group 101 through 103 and load group 105 through 108, the polygonal motor 110 continues to rotate due to the rotation of the polygonal mirror via the force of inertia. At this time, the microcomputer outputs a signal to the eraser 107 to set the operating state of said eraser 107.

Figure 6:
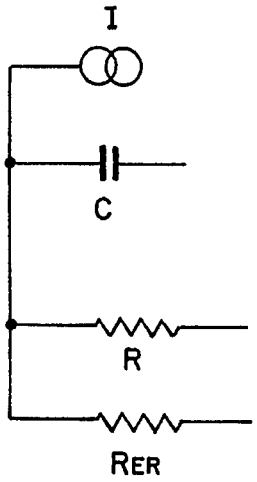
FIG. 6 is an illustration showing the equivalent circuit after the operation of eraser 107 in the circuit of FIG. 5.

FIG. 6 shows an equivalent circuit of the circuit of FIG. 5 when the eraser 107 is in an operating state. In the drawing, the current source I expresses the regenerative current produced by the polygonal motor 110; electrostatic capacitance C expresses total electrostatic capacitance of the electrolytic condenser provided in the circuit; load resistance R expresses the impedance within the circuit; and resistance Rer expresses the resistance of the eraser 107. The relation Rer<R obtains.

When the cover 3 is in a opened state and the safety switch SW is turned OFF, the load resistance R is extremely large because all components are in a non-load state with the exception of the eraser 107. However, as shown in FIG. 6, the current generated from the current source I and electrostatic capacitance C flows due to the resistance Rer, such that the eraser 107 is actuated.

Figure 7:
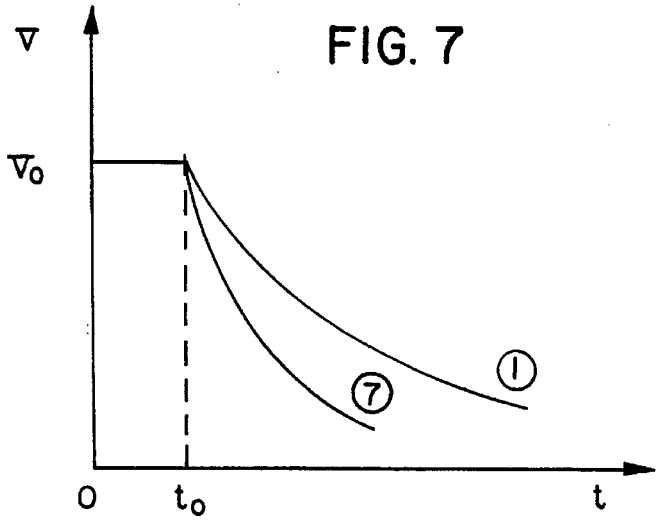
FIG. 7 shows changes over time of the circuit voltage when the safety switch SW is turned from ON to OFF.

FIG. 7 shows the change over time of the voltage of the circuit in FIG. 5 when the safety switch SW is switched from the ON state to the OFF state in conjunction with the operation of opening the cover 3. In the drawing, the curved line designated curve (2) expresses the change in circuit voltage when the eraser 107 is actuated at time to when the safety switch SW is turned OFF in conjunction with the operation of opening the cover 3. The curved line designated curve (1) expresses a reference circuit voltage when the eraser 107 is not actuated after the safety switch SW is turned OFF.

As can be clearly understood from FIG. 7, when the eraser 107 is actuated after the safety switch SW is turned OFF (refer to curve (2) in the drawing), the rotational speed of the polygonal mirror is reduced, and the charge accumulated in the condenser is discharged. Accordingly, it can be understood that the circuit voltage is rapidly reduced from an initial value V0 compared to the case wherein the eraser 107 is not actuated (refer to curve (1) in the drawing).

Although, in the second embodiment, the eraser 107 is operated after the safety switch SW is turned OFF, it is to be understood that another load, such as the clutch 105, solenoid 106 or the like, may be operated instead of said eraser 107 insofar as safety is not impaired. Moreover, a grounded connection may be similarly employed.

Furthermore, a regenerative braking device may be provided specifically for braking the rotation of the polygonal mirror, said braking device being actuated after the safety switch SW is operated.

The first and second embodiments of the invention have been described in terms of a polygonal motor as the object generating a regenerative electrical force, it is to be noted that the invention is not limited to such an arrangement inasmuch as a motor for driving a galvano-mirror or the like may continue to rotate via the force of inertia after the electric current supplied to said motor is cut off, thereby generating a regenerative electric force.

In the invention as previously described provides, after a motor is electrically disconnected from a power source by a safety switch, said motor is electrically disconnected from a circuit connected thereto by means of a diode. Therefore, the effects of a regenerative electric force generated by said motor in a circuit connected to said motor are eliminated, and the voltage of said circuit connected to said motor is less than a standard safety voltage level.

In the present invention, after a motor is electrically disconnected from a power source by a safety switch, a load is operated by means of the regenerative electric force generated by said motor. This situation results in a reduction of the regenerative electric force generated by said motor, such that the voltage of the circuit connected to said motor is rapidly reduced to less than a standard safety level.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. An image forming apparatus comprising:

a motor;

a power source for driving said motor, said motor capable of providing a regeneration current when said power source is disconnected;

a cover provided so as to be capable of opening and closing relative to a body of the apparatus;

a safety switch for switching an electrical connection and a disconnection between said motor and said power source in conjunction with the opening and closing operation of said cover; and an interrupt member for interrupting an outflow of any regeneration current generated by said motor when said motor is disconnected from said power source by said safety switch.

2. The image forming apparatus as claimed in claim 1, further comprising loads;

wherein said loads are disposed between said motor and said power source, and said interrupt member is electrically connected between said motor and said loads which are driven for forming images so as not to flow the regeneration current generated by said motor towards the loads.

3. The image forming apparatus as claimed in claim 2, wherein said interrupt member is a rectification member.

4. The image forming apparatus as claimed in claim 3, wherein said rectification member is a diode of which a cathode is connected to said motor and an anode is connected to said power source.

5. The image forming apparatus as claimed in claim 1, wherein said motor rotates a polygonal mirror.

6. An image forming apparatus comprising:

a plurality of electrically driven members defining electrical loads for forming images, including a motor;

a power source for driving said motor and said loads;

a cover provided so as to be capable of opening and closing relative to a housing body of the apparatus;

a safety switch positioned between said power source and said loads for electrically disconnecting said loads from said power source when said cover is opened; and a controller, connecting said motor and said loads for energizing said loads when said safety switch disconnects said loads from said power source so as to apply a regeneration current which is generated by said motor when said cover is opened.

7. The image forming apparatus as claimed in claim 6, wherein said loads are connected to said motor so as to be driven by said regenerative current when said cover is opened.

8. The image forming apparatus as claimed in claim 6, wherein said motor rotates a polygonal mirror.

9. An image forming apparatus comprising:

a motor for driving a scanning mirror;

a power source for driving said motor, said motor capable of disconnected;

an openable cover to a body of the apparatus;

a safety switch for electrically disconnecting said motor from said power source when said cover is opened; and a braking device connected to said motor for braking the rotation of said scanning mirror by receiving a regeneration current generated by an inertia force of said scanning mirror and said motor after said cover is opened.

10. The image forming apparatus as claimed in claim 9, wherein said braking device is electrically connected between said motor and said safety switch.

11. An image forming apparatus comprising:

a motor:

plural loads which are electrically driven for forming images;

a power source for driving said motor and said plural loads;

a cover provided so as to be capable of opening and closing relative to a body of the apparatus;

a safety switch for switching an electrical connection and a disconnection between said motor and said power source in conjunction with the opening-closing operation of said cover; and a controller for controlling an operation of said motor and said loads for forming images when said cover is closed and for actuating at least a predetermined load of said plural loads to be driven be a regenerative current generated by an inertial movement of said motor when said cover is opened and said power source is disconnected.

12. The image forming apparatus as claimed in claim 11 wherein one of said loads is an eraser circuit for eliminating charges on a photosensitive member and said controller applies the regenerative current to said eraser circuit when said safety switch is activated to disconnect said power source and said motor.

13. An image forming apparatus comprising:

a polygonal mirror;

a polygonal motor for rotating said polygonal mirror;

a power source for driving said polygonal motor;

a cover provided so as to be capable of opening and closing relative to a body of the apparatus;

a safety switch for switching an electrical connection and a disconnection between said polygonal motor and said power source in conjunction with the opening-closing operation of said cover, said polygonal motor capable of providing a regeneration current when said power source is disconnected;

a interrupt member for interrupting an outflow of any regeneration current generated by said polygonal motor due to a rotation of said polygonal motor via the force of inertia, when said polygonal motor is electrically disconnected from said power source by operation of said safety switch.

14. The image forming apparatus as claimed in claim 13, further comprising loads, wherein said loads are disposed between said motor and said power source, and said interrupt member is electrically connected between said motor and said loads which are driven for forming images so as not to flow the regeneration current generated by said motor towards the load.

15. An image forming apparatus comprising:

a polygonal mirror;

a plurality of loads which are driven for forming images, including a polygonal motor for rotating said polygonal mirror;

a power source for driving said polygonal motor;

a cover provided so as to be capable of opening and closing relative to a body of the apparatus;

a safety switch for electrically disconnecting said loads from said power source when said cover is opened; and a controller for energizing said plural loads except for said polygonal motor so as to apply a regeneration current generated by said motor thereto when said cover is opened.

16. An image forming apparatus comprising:

a motor for driving a scanning mirror;

a power source for driving said motor;

an openable cover to a body of the apparatus;

a safety switch for electrically disconnecting said motor from said power source when said cover is opened; and a braking device for braking the rotation of said scanning mirror by a regeneration current generated by the motor due to a rotation of said scanning mirror via the force of inertial after said cover is opened.

* * * * *